US008228156B2

(12) United States Patent
Lim et al.

(10) Patent No.: US 8,228,156 B2
(45) Date of Patent: Jul. 24, 2012

(54) INSULATION TRANSFORMER AND KEY INPUT CIRCUIT HAVING THE SAME

(75) Inventors: Jun-Young Lim, Seoul (KR); Sang-Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 581 days.

(21) Appl. No.: 12/446,019

(22) PCT Filed: Oct. 17, 2007

(86) PCT No.: PCT/KR2007/005073

§ 371 (c)(1),
(2), (4) Date: Apr. 17, 2009

(87) PCT Pub. No.: WO2008/048040

PCT Pub. Date: Apr. 24, 2008

(65) Prior Publication Data

US 2010/0321961 A1 Dec. 23, 2010

(30) Foreign Application Priority Data

Oct. 18, 2006 (KR) ..... 10-2006-0101551

(51) Int. Cl.
*H01F 5/00* (2006.01)
*G05F 1/325* (2006.01)

(52) U.S. Cl. ..... 336/200; 336/223; 336/232; 323/250

(58) Field of Classification Search ..... 336/200, 336/223, 232; 323/250
See application file for complete search history.

(56) References Cited

U.S. PATENT DOCUMENTS

| | | | | |
|---|---|---|---|---|
| 3,899,638 | A * | 8/1975 | Hahn | 379/93.26 |
| 4,562,382 | A * | 12/1985 | Elliott | 315/219 |
| 5,107,390 | A | 4/1992 | Goldner | |
| 5,543,773 | A * | 8/1996 | Evans et al. | 336/183 |
| 6,593,839 | B2 * | 7/2003 | Nakayama et al. | 336/182 |
| 7,019,611 | B2 * | 3/2006 | Kaku et al. | 336/178 |
| 7,120,006 | B2 * | 10/2006 | Sekoguchi et al. | 361/230 |
| 7,182,077 | B2 * | 2/2007 | Ward | 123/634 |

FOREIGN PATENT DOCUMENTS

| | | | |
|---|---|---|---|
| JP | 10-189351 | A | 7/1998 |
| JP | 2003-234220 | A | 8/2003 |
| JP | 2005-39050 | A | 2/2005 |

* cited by examiner

*Primary Examiner* — Jessica Han
(74) *Attorney, Agent, or Firm* — Birch, Stewart, Kolasch & Birch, LLP

(57) ABSTRACT

An insulation transformer and a key input circuit having the same are disclosed. The insulation transformer includes: a core having a certain gap; and primary and secondary coils wound on the core. According to the insulation transformer, the operation deficiency of the insulation transformer can be reduced and thus the signal transmission efficiency can be improved. Also, the key input circuit including: an insulation transformer includes a core having a certain gap, and primary and secondary coils wound on the core; a microcomputer connected with the primary coil; and a key input unit connected with the secondary coil and including multiple resistors and switches. According to the key input circuit having the insulation transformer, the reliability of the operation of the key input circuit can be improved and user inconvenience that may be caused by an operation error can be prevented.

7 Claims, 5 Drawing Sheets

[Fig. 1]
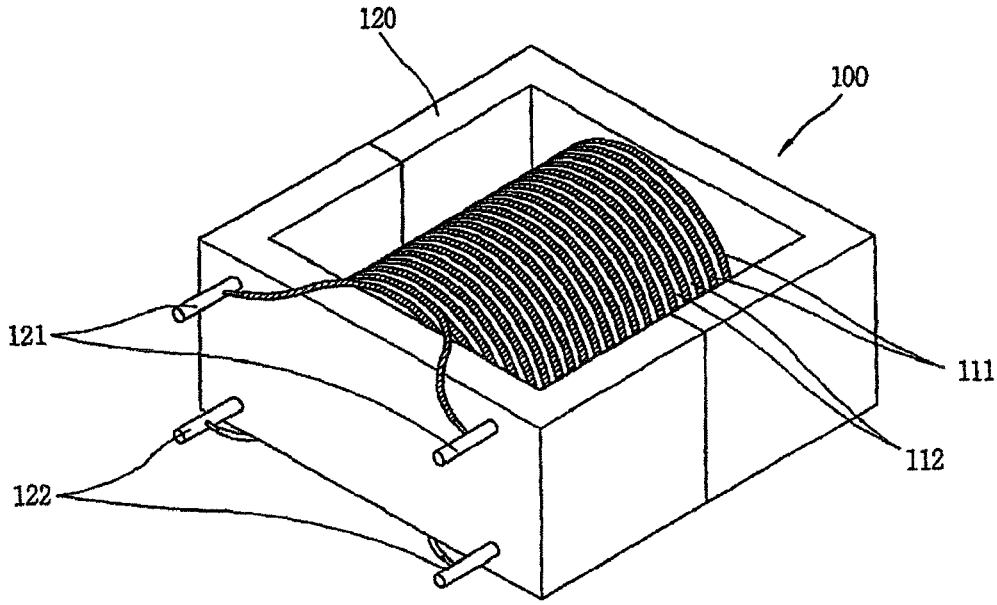
[Fig. 2]
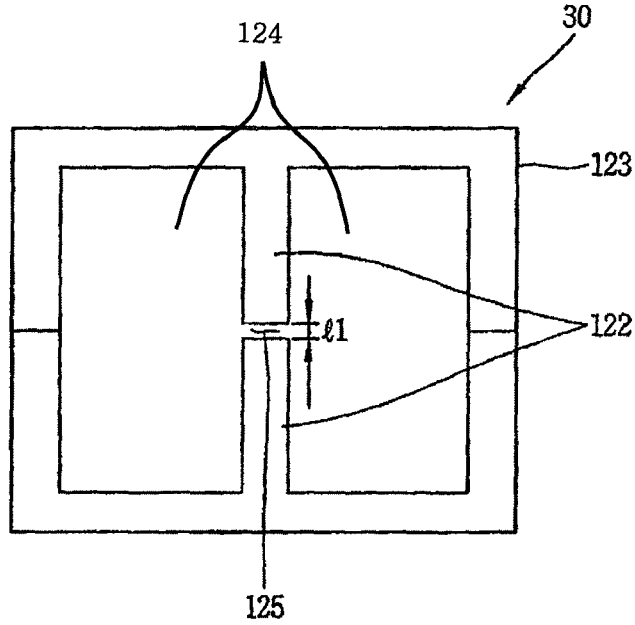

[Fig. 3]
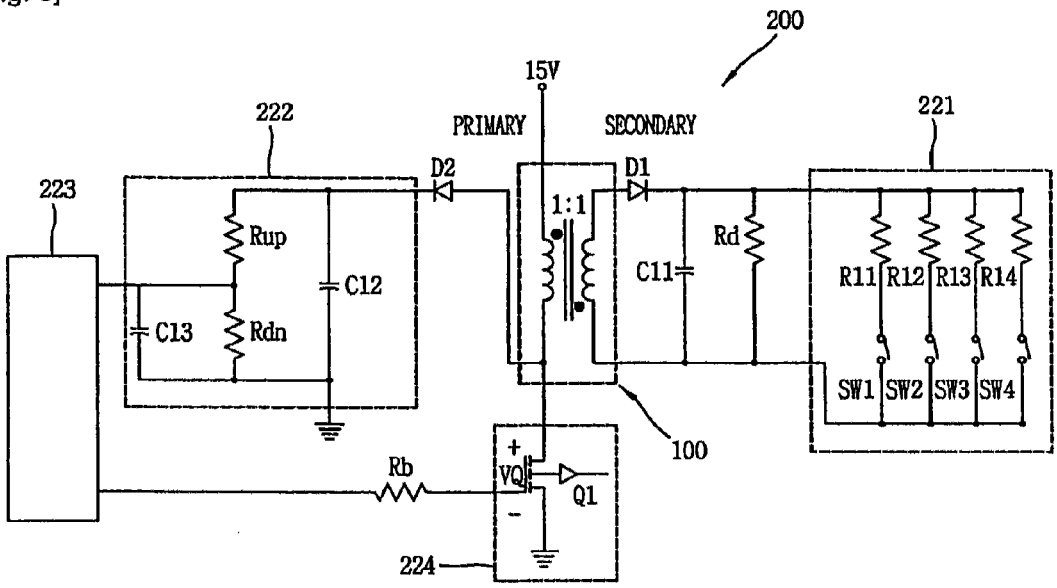
[Fig. 4]
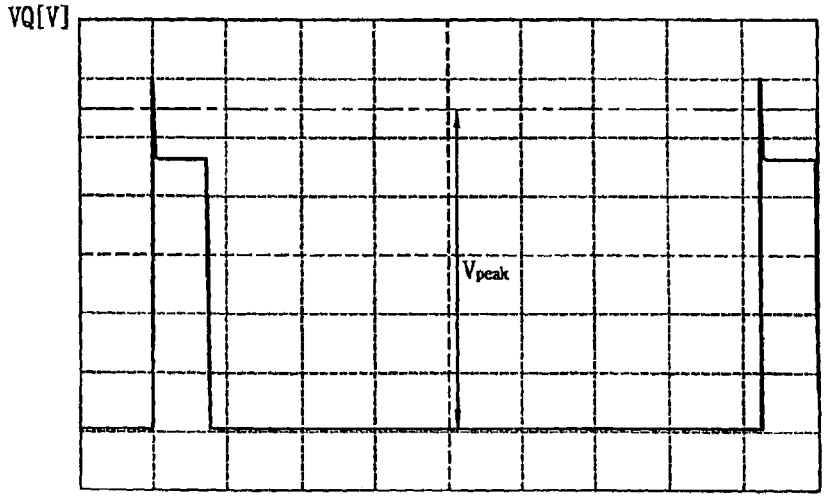

[Fig. 5]
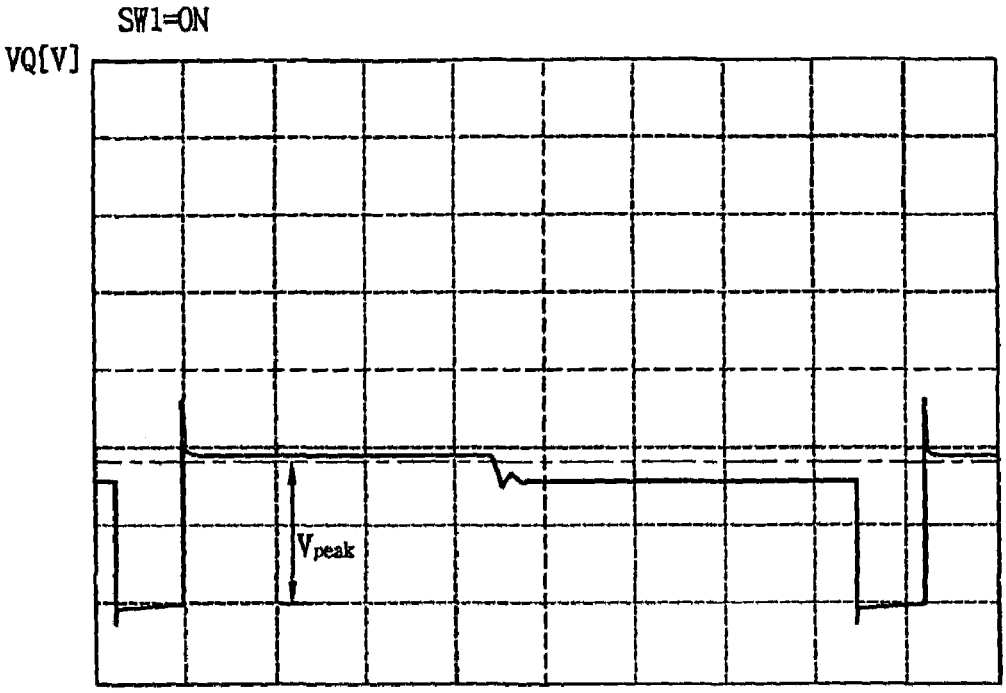
[Fig. 6]
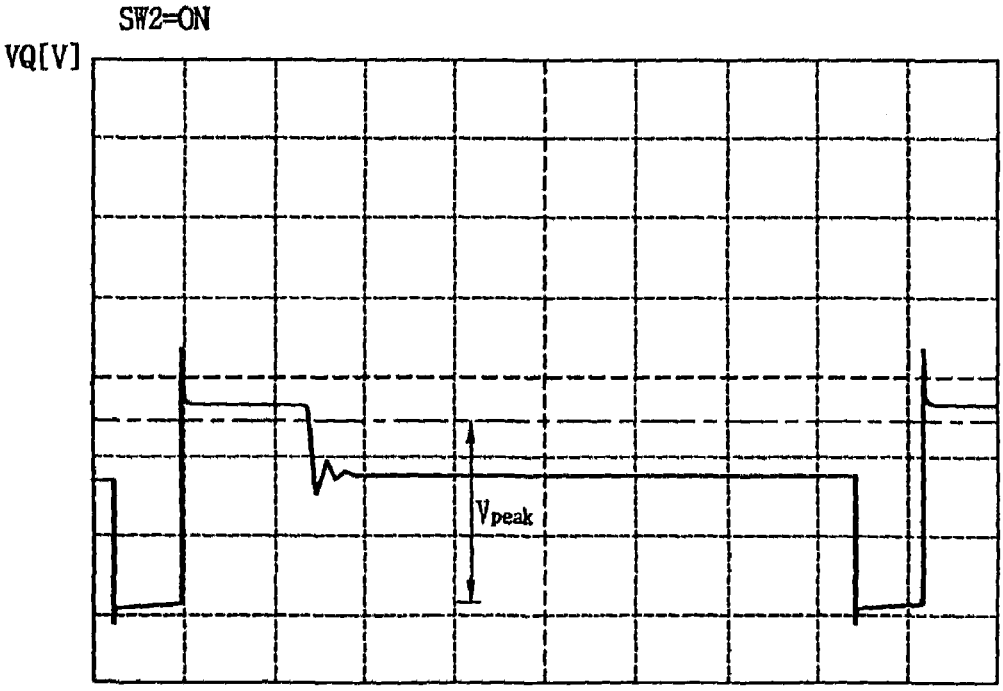

[Fig. 7]
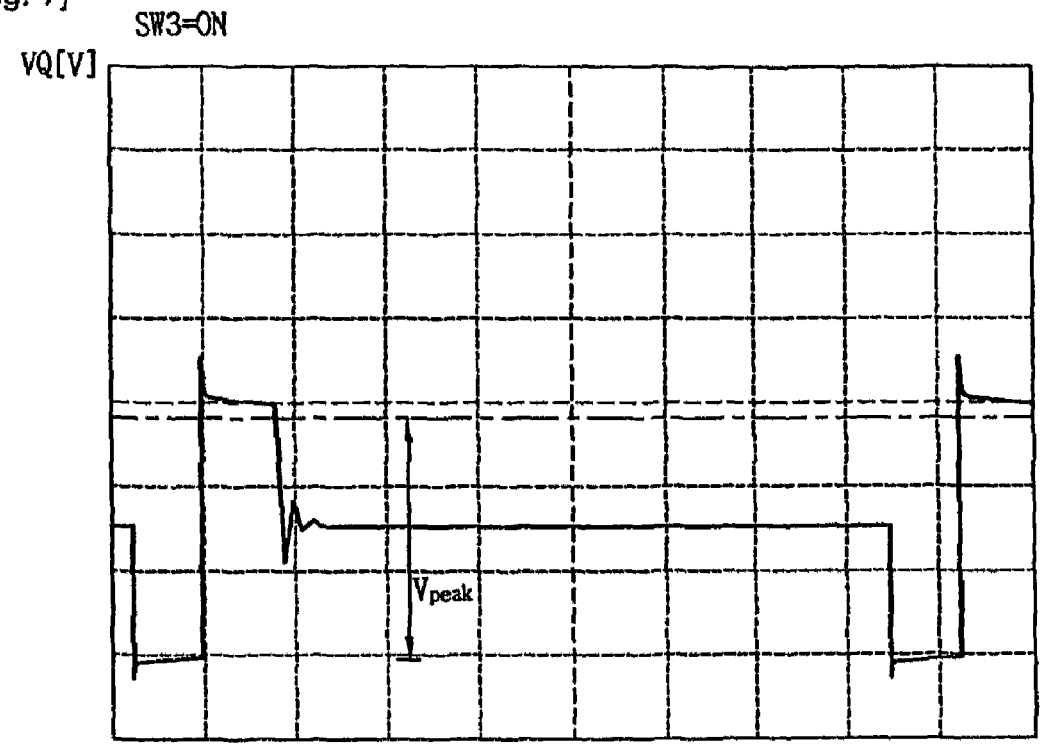
[Fig. 8]
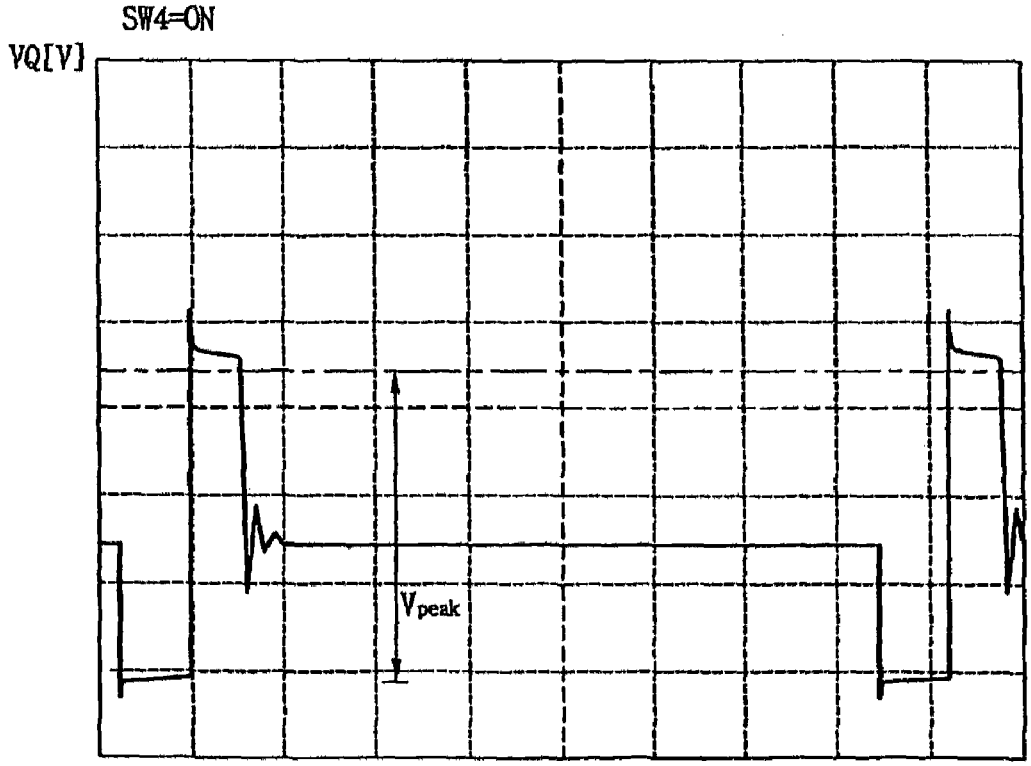

[Fig. 9]
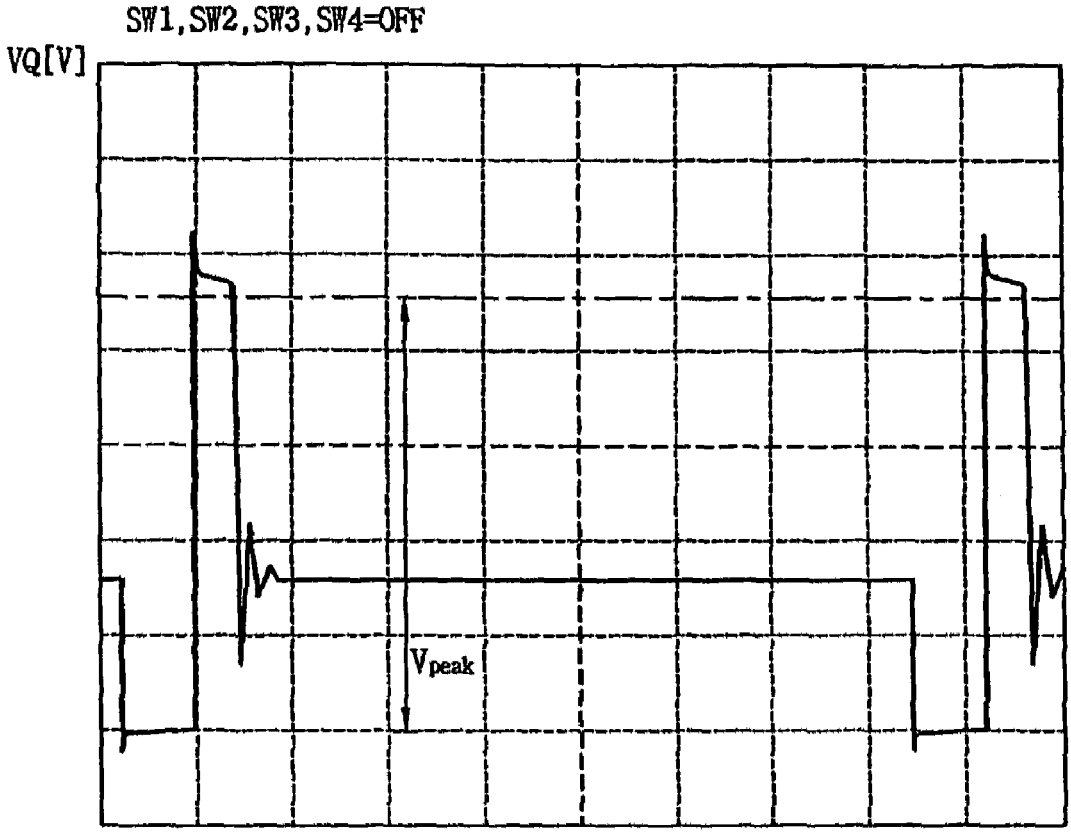

INSULATION TRANSFORMER AND KEY INPUT CIRCUIT HAVING THE SAME

TECHNICAL FIELD

The present invention relates to an insulation transformer and a key input circuit having the same, and more particularly, to an insulation transformer capable of improving a signal transmission efficiency of a key input circuit, and a key input circuit having the same.

BACKGROUND ART

In general, electronic appliances include a key input circuit for receiving an operation signal from the exterior. Such key input circuit includes a key input unit that generates a key input signal from the exterior and a microcomputer that controls an operation of an electronic appliance upon recognizing the key input signal.

One key input method of the related art key input circuit is to recognize an operation signal of a user based on a difference between divided voltages generated according to a key input by using DC power and resistors.

In this method, however, because the key input unit and the microcomputer use a common ground, if a ground voltage level itself of the microcomputer has a certain potential, there is a possibility of the danger of an electrical shock.

Meanwhile, another key input method of the related art key input circuit is to completely separate the key input unit and power unit connected with the microcomputer by using a transformer.

That is, unlike the voltage dividing method, a key connected with a secondary side of the transformer is pressed to change voltage at the secondary side, and such change causes a change in voltage at a primary side of the transformer. At this time, a peak value of the generated voltage of the primary side is detected in order to input an operation signal of the user to the microcomputer.

In this method, the key input unit and the power unit are completely separated, so there is no danger of an electrical shock. In this sense, the transformer is called an insulation transformer.

However, the key input circuit according to this method has a problem in that because a signal transmission ratio, namely, a ratio of the primary side voltage to the secondary side voltage, is not good due to an operation deviation of the insulation transformer, the key input circuit may perform a different operation that does not correspond to a key input signal.

TECHNICAL GIST OF THE PRESENT INVENTION

Therefore, it is an object of the present invention to provide an insulation transformer capable of preventing an electrical shock in a key input, reducing an operation deviation of the insulation transformer, and improving a signal transmission ratio, namely, a ratio of a primary side voltage to a secondary side voltage of the insulation transformer, and a key input circuit having the same.

To achieve the above object, there is provided an insulation transformer including: a core having a certain gap; and primary and secondary coils wound on the core.

To achieve the above object, there is also provided a key input circuit including: an insulation transformer including a core having a certain gap, and primary and secondary coils wound on the core; a microcomputer connected with the primary coil; and a key input unit connected with the secondary coil and including multiple resistors and switches.

The primary and secondary coils may be wound in a bifilar manner.

The core includes a first core unit having a certain gap and having the primary and secondary coils wound thereon; and a second core unit connected with both ends of the first core unit to form a space in which the primary and secondary coils are wound.

The primary and secondary coils may be formed as multiple wires. In particular, the primary and secondary coils are formed as triple-strand wires.

A primary side port pin and a side secondary port pin may be connected with the primary coil and the secondary coil and are exposed.

The distance between the primary and secondary port pins may be 8 mm or larger.

According to the insulation transformer, because the core on which the primary and secondary coils are wound has a gap and in this case the primary and secondary coils are wound in the bifilar manner to prevent an increase in a leakage flux, the operation deficiency of the insulation transformer can be reduced and thus the signal transmission efficiency can be improved.

In addition, according to the key input circuit having the insulation transformer, because a switching signal transferred from the key input unit is recognized by the microcomputer without an error, the reliability of the operation of the key input circuit can be improved and user inconvenience that may be caused by an operation error can be prevented.

BRIEF DESCRIPTION OF THE DRAWINGS

FIG. 1 is a perspective view of an insulation transformer according to a first embodiment of the present invention;

FIG. 2 is a plan view of a core of the insulation transformer according to the first embodiment of the present invention;

FIG. 3 is a circuit diagram showing a key input unit according to the first embodiment of the present invention;

FIG. 4 is a graph showing a waveform of a signal inputted to a main switch in the key input circuit in FIG. 3;

FIG. 5 is a graph showing a voltage applied to both ends of the main switch when a first switch SW1 is in an ON state in FIG. 3;

FIG. 6 is a graph showing a voltage applied to both ends of the main switch when a second switch SW2 is in an ON state in FIG. 3;

FIG. 7 is a graph showing a voltage applied to both ends of the main switch when a third switch SW3 is in an ON state in FIG. 3;

FIG. 8 is a graph showing a voltage applied to both ends of the main switch when a fourth switch SW4 is in an ON state in FIG. 3; and FIG. 9 is a graph showing a voltage applied to both ends of the main switch when all the switches SW1, SW2, SW3 and SW4 are in an OFF state in FIG. 3.

MODE FOR CARRYING OUT THE PREFERRED EMBODIMENTS

An insulation transformer and a key input circuit having the same according to preferred embodiments of the present invention will now be described with reference to the accompanying drawings.

FIG. 1 is a perspective view of an insulation transformer according to a first embodiment of the present invention, and FIG. 2 is a plan view of a core of the insulation transformer according to the first embodiment of the present invention.

As shown in FIG. 1, the insulation transformer 100 according to the embodiment of the present invention includes a core 120 on which a primary coil 111 and a secondary coil 112 are wound, and multiple port pins 121 and 122 connected with the primary and secondary coils 111 and 112 and exposed to outside.

Here, the primary and secondary coils 111 and 112 are wound in the core in such a bifilar manner that two wires are wound together.

As shown in FIG. 2, the core 120 includes a first core unit 122 on which the primary and the secondary coils 111 and 112 are wound together and a second core unit 123 connected with both ends of the first core unit 122, providing a space 124 in which the primary and secondary coils 111 and 112 are wound with the side of the first core unit 122, and formed to surround the circumference of the first core unit 122.

A gap 125 is formed at the middle of the first core unit 122 in order to reduce an operation deficiency of the insulation transformer 100. Formation of the gap 125 reduces generation of inductance of the coils, which leads to a reduction of the operation deficiency of the insulation transformer 100. This can be expressed by equation shown below:

$$L=(\mu 1 \cdot S1/l1)+(\mu 2 \cdot S2/l2)$$

Wherein 'L' is generated inductance, μ1 and μ2 are magnetic permeability of a material of the first and second core units 122 and 123, S1 and S2 are sectional areas of the first and second core units 122 and 123, l1 is a space of the gap 125, and l2 is the length of circumference of the space 124 between the first core unit 122 and the second core unit 123.

Namely, with the gap 125 formed at the first core unit 122 on which the primary and secondary coils 111 and 112 are wound, a generation rate of inductance is reduced according to the space l1 of the gap 125. In this case, because the primary and secondary coils 111 and 112 are wound together on the first core unit 122, an increase in the leakage flux according to formation of the gap 125 can be prevented.

Meanwhile, preferably, the primary and secondary coils 111 and 112 are formed as multiple wires to satisfy a safety standard and improve stability, and for example, the primary and secondary coils 111 and 112 are formed as triple-strand wires.

Preferably, the port pins 121 and 122 are installed to be spaced apart by 8 mm or larger therebetween to obtain stability of the insulation transformer 100.

Accordingly, in the insulation transformer 100 according to the first embodiment of the present invention, because the gap 125 is formed at the first core unit 122 on which the primary and secondary coils 111 and 112 are wound, and the primary and secondary coils 111 and 112 are wound together on the first core unit 122, the operation deficiency of the insulation transformer 100 can be reduced compared with that of the related art. Thus, the signal transmission ratio can be improved.

TABLE 1

Comparison of the insulation transformer of the present invention and that of the related art:

| | Operation deficiency of insulation transformer | Signal transmission ratio |
|---|---|---|
| Related art insulation transformer | 30% | 2.40 |

TABLE 1-continued

Comparison of the insulation transformer of the present invention and that of the related art:

| | Operation deficiency of insulation transformer | Signal transmission ratio |
|---|---|---|
| Insulation transformer of the present invention | 10% | 6.75 |

The key input unit having the insulation transformer according to the first embodiment of the present invention will now be described with reference to the accompanying drawings.

FIG. 3 is a circuit diagram showing a key input unit according to the first embodiment of the present invention.

As shown in FIG. 3, the key input circuit according to the first embodiment of the present invention includes a key input unit 221, an insulation transformer 100, a scaling unit 222, a microcomputer 223, and a main switch 224.

The key input unit 221 includes switches SW1, SW2, SW3 and SW4 connected in series with multiple resistors R11, R12, R13 and R14. Thus, a certain divided voltage is outputted to an output terminal of the key input unit 221 according an ON or OFF operation of the switches SW1, SW2, SW3 and SW4.

In the insulation transformer 100, as mentioned above, the gap 125 is formed at the first core unit 122 on which the primary and secondary coils 111 and 112 are wound, the primary coil 111 and the secondary coil 112 are wound together on the first core unit 122, and the divided voltage outputted to the output terminal of the key input unit 221 is transferred to a primary side.

The scaling unit 222 scales the voltage, which has been transferred to the primary side by the insulation transformer 100, according to a certain standard, and outputs the same.

The microcomputer 223 recognizes an input signal of the key input unit 221 based on the voltage outputted by the scaling unit 222, and controls the key input circuit 200. Namely, the microcomputer 223 detects a switching state of the key input unit 221 by driving the main switch Q1 connected with the microcomputer 223 with a certain frequency. In detail, the microcomputer 223 detects the switching state of the key input unit 221 through a peak voltage of a voltage VQ at both ends of the main switch Q1 according to the voltage of the output terminal of the key input unit 221.

The operation of the key input circuit according to the first embodiment of the present invention will now be described with reference to FIGS. 4 to 9.

FIG. 4 is a graph showing a waveform of a signal inputted to the main switch by the microcomputer in the key input circuit according to the first embodiment of the present invention. FIGS. 5-8 are graphs showing waveforms at both ends of the main switch according to a switching state of the key input unit according to the first embodiment of the present invention. FIG. 9 is a graph showing a waveform of a voltage at both ends of the main switch when all the switches of the key input unit are in an OFF state according to the first embodiment of the present invention.

As shown in FIG. 4, a signal having a certain duty ratio is inputted to the main switch 224 from the microcomputer 223. At this time, when one of the switches provided in the key input unit 221 is pressed, the signal of the voltage applied to the both ends of the main switch 224 changes and the microcomputer 223 detects a peak value VQ of the changed voltage signal to detect a switching state of the key input unit.

The changed signal of the voltage at the both ends of the main switch 224 is shown in FIGS. 5-8 according to the switching state of the key input unit 221.

As shown in FIGS. 5-8, in the key input circuit 200 according to the first embodiment of the present invention, a distortion degree of the peak value VQ of the signal at the both ends of the main switch 224 according to the switching state of the key input unit 221 can be reduced by the insulation transformer 100. Namely, a switching state recognition error of the key input unit 221 by the microcomputer 223 can be prevented. In addition, as shown in FIG. 9, a confusion with the peak value VQ of the voltage at the both ends of the main switch 224 when all the switches of the key input unit 221 are turned off can be also prevented.

INDUSTRIAL APPLICABILITY

Accordingly, in the key input circuit according to the first embodiment of the present invention, because the switching signal transferred from the key input unit can be recognized by the microcomputer without an error, the operation reliability of the key input circuit can be improved and a user inconvenience that may be caused by an operation error can be prevented.

In addition, in the insulation transformer according to the embodiment of the present invention, because the gap is formed at the core on which the primary coil and the secondary coil are wound, and the primary coil and the secondary coil are wound in the bifilar manner to prevent an increase in the leakage flux, whereby the operation deficiency of the insulation transformer can be reduced to thus improve the signal transmission efficiency of the key input circuit.

The invention claimed is:

1. A key input circuit comprising:

an insulation transformer comprising a core having a certain gap, and primary and secondary coils wound together on the core;

a microcomputer connected with the primary coil; and a key input unit connected with the secondary coil and including multiple resistors and switches.

2. The circuit of claim 1, wherein the primary coil and the secondary coil are wound in a bifilar manner.

3. The circuit of claim 1, wherein the core comprises:

a first core unit having a certain gap and having the primary and secondary coils wound thereon; and a second core unit connected with both ends of the first core unit to form a space in which the primary and secondary coils are wound and formed around the first core unit.

4. The circuit of claim 1, wherein the primary and secondary coils are formed as multiple wires.

5. The circuit of claim 1, wherein the primary and secondary coils are formed as triple-strand wires.

6. The circuit of claim 1, wherein a primary side port pin and a secondary side port pin are respectively connected with the primary coil and the secondary coil and are exposed.

7. The circuit of claim 6, wherein the distance between the primary and secondary side port pins is 8 mm or larger.

* * * * *